United States Patent [19]

Miller

[11] Patent Number: 4,705,559

[45] Date of Patent: Nov. 10, 1987

[54] METHOD FOR PRODUCING FINE COBALT METAL POWDER

[75] Inventor: Michael J. Miller, Towanda, Pa.

[73] Assignee: GTE Products Corporation, Stamford, Conn.

[21] Appl. No.: 835,075

[22] Filed: Feb. 28, 1986

[51] Int. Cl.[4] ..... C22B 23/04

[52] U.S. Cl. ..... 75/0.5 AA

[58] Field of Search ..... 75/0.5 AA

[56] References Cited

U.S. PATENT DOCUMENTS

| | | | |
|---|---|---|---|
| 4,214,895 | 7/1980 | Gingerich | 75/0.5 AA |
| 4,329,169 | 5/1982 | Gingerich | 75/0.5 AA |
| 4,395,278 | 7/1983 | Vanderpool | 75/0.5 AA |

*Primary Examiner*—Peter D. Rosenberg

*Attorney, Agent, or Firm*—Donald R. Castle; L. Rita Quatrini

[57] ABSTRACT

A method is disclosed for producing fine cobalt metal powder. The method involves digesting a cobaltic ammine halide in an aqueous solution with a mineral acid at a temperature of at least about 110° C. for a sufficient time to decompose the cobaltic ammine halide to form an amorphous hydrated cobalt oxide containing precipitate. The digestion step is carried out at a suitable pressure in a sufficiently closed vessel to permit the temperature to be attained in the solution. The aqueous solution of the cobaltic ammine halide contains from about 5 grams of cobalt per liter up to the limits of solubility of the cobaltic ammine halide. The mineral acid is present in an amount sufficient to result in the subsequent cobalt metal powder having a Fisher Subsieve Size of no greater than about 2.1. The cobalt containing precipitate is separated from the resulting solution and reduced to form the fine cobalt powder.

6 Claims, No Drawings

METHOD FOR PRODUCING FINE COBALT METAL POWDER

BACKGROUND OF THE INVENTION

This invention relates to the production of fine cobolt metal powder by reduction of a precipitate obtained by digestion of a cobaltic ammine halide in an aqueous solution containing a mineral acid.

Fine cobalt powder of high purity is typically used in the manufacture of cemented carbide cutting tools, magnetic tapes, and magnetic inks.

U.S. Pat. No. 4,184,868 relates to a method for producing extra fine cobalt metal powder by digesting cobalt pentammine choride in ammonium hydroxide to obtain a black precipitate which contains cobalt and which is thereafter reduced to metal powder. U.S. Pat. Nos. 4,214,894, 4,233,063, and 4,278,463 relate to improvements in U.S. Pat. No. 4,184,868 in which the ammonia solutions are produced to recover any cobalt therein. U.S. Pat. Nos. 4,395,278 and 4,469,505 relate to improvements in U.S. Pat. No. 4,184,868 in which fine cobalt metal powder is produced having reduced tailings.

U.S. Pat. No. 4,214,895 relates to a process for producing cobalt metal powder which involves treating an aqueous solution of a soluble cobaltic ammine halide with a sufficient amount of a soluble metallic hydroxide to form a cobalt containing precipitate which is thereafter reduced to metallic cobalt.

U.S. Pat. No. 4,218,240 relates to a method for producing cobalt metal powder by forming a solution of a cobalt hexammine compound and treating the solution with a metallic hydroxide to form a precipitate which is reduced to cobalt metal powder. U.S. Pat. Nos. 4,348,224 and 4,381,937 relate to improvements in the process described in U.S. Pat. No. 4,218,240 which involve removal of copper and silver from the cobalt. U.S. Pat. No. 4,452,633 relates to an improvement in the processes described in U.S. Pat. Nos. 4,218,240 and 4,348,224 in which the silver is recovered.

U.S. Pat. No. 4,093,450 to Doyle et al describes a process for producing fine particle size cobalt metal powder by the hydrogen reduction of cobalt oxide obtained from a cobalt pentammine carbonate solution. The precipitate is formed by heating the solution to drive off ammonia and carbon dioxide to form a precipitate of cobalt oxide. This process requires a solution of about 4 grams of cobalt per liter to produce a metal powder having a particle size of less than about 1 micron. Note that the final resulting particle size of less than about 1 micron is highly dependent on the concentration of cobalt employed in the aqueous solution.

U.S. Pat. No. 4,329,169 relates to a process for producing fine cobalt metal powder absent tailings by heating an aqueous solution of soluble cobalt ammine halide to decompose the halide and form a cobalt containing precipitate which is reduced to the cobalt metal powder.

ducing fine cobalt metal powder from pieces of relatively pure cobalt by dissolving the cobalt pieces in an aqueous solution of hydrogen iodide and iodine and forming a cobalt containing solid which is subsequently reduced to a fine cobalt metal powder.

SUMMARY OF THE INVENTION

In accordance with one aspect of this invention, there is provided a method for producing fine cobalt metal powder. The method involves digesting a cobaltic ammine halide in an aqueous solution with a mineral acid at a temperature of at least about 100° C. for a sufficient time to decompose the cobaltic ammine halide to form an amorphous hydrated cobalt oxide containing precipitate. The digestion step is carried out at a suitable pressure in a sufficiently closed vessel to permit the temperature to be attained in the solution. The aqueous solution of the cobaltic ammine halide contains from about 5 grams of cobalt per liter up to the limits of solubility of the cobaltic ammine halide. The mineral acid is present in an ammount sufficient to result in the subsequent cobalt metal powder having a Fisher Subsieve Size of no greater than about 2.1. The cobalt containing precipitate is separated from the resulting solution and reduced to form the fine cobalt powder.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

By the method of this invention, fine particle size cobalt having a Fisher Subsieve Size (FSSS) of no greater than about 2.1 is produced directly by reduction of a cobalt containing precipitate which is formed by heating or digesting an aqueous solution of a cobaltic ammine halide with a mineral acid.

The cobaltic ammine halide is preferably cobaltic pentammine halide, cobaltic hexammine halide, or mixtures thereof, with the most preferred being cobaltic hexammine chloride.

The cobaltic ammine halide is obtained by known methods, the preferred methods being described in U.S. Pat. Nos. 4,218,240, 4,233,063, 4,214,894, and 4,278,463. These patents are hereby incorporated by reference.

In accordance with a preferred embodiment, the cobaltic ammine halide is washed with acetone to remove any excess liquers which may be present from prior processing. The cobaltic ammine halide is slurried in acetone followed by removal of the resulting wash solution by filtration. The resulting washed cobaltic ammine halide is then air dried.

A solution is formed consisting essentially of the cobaltic ammine halide, water, and typically less than about 2% by weight impurities based on cobalt present in solution, and a mineral acid. The solution can have a wide range of cobalt concentrations ranging from about 5 g Co/l up to the limits of solubility of the cobaltic ammine halide. It is preferable that this solution contain from about 10 to about 30 g Co/l . The mineral acid which is preferably hydrochloric acid is added in an amount required to give the desired Fisher Subsieve Size in the subsequently produced cobalt metal powder. As more acid is added, the FSSS is reduced to some minimum value. If a large excess of acid is added, the particle size is not noticeably reduced. For example, the amount of hydrochloric acid is present at least about 0.04 mole per mole of cobalt, preferably from about 0.04 to about 1.0 moles per mole of cobalt, and most preferably from about 0.09 to about 0.20 moles per mole of cobalt. When the amount of hydrochloric acid is at least about 0.04 moles per mole of cobalt, the FSSS of the subsequently produced cobalt metal powder is no greater that about 2.1. Controlling the amount of hydrochloric acid in the digestion step affords a method of controlling the FSSS of the subsequently produced cobalt metal powder. This will become apparent in the examples that follow.

The Fisher Subsieve Size is a unitless measurement of particle size which has gained industrial acceptance. The Sub Sieve apparatus is available commercially from Fisher Scientific Co. for taking advantage of the air permeability method. The method is based on the relation between specific surface of packed particles and their permeability [Caeman, J. Soc. Chem. Inc. (London, 57,225 (1938)]. The air permeability method relates to average particle size and does not give particle size distribution.

The resulting cobaltic ammine halide solution is heated or digested at a temperature of at least about 110° C. and preferably from about 120° C. to about 200° C. for a sufficient time to decompose the cobaltic ammine halide and form an amorphous hydrated cobalt oxide containing precipitate. The digestion step is carried out in a sufficiently closed vessel to permit the temperature to be attained in the solution. The pressure can be adjusted to allow the temperature to be attained. The heating time depends on the temperature, pressure, and on the nature of the equipment.

The cobalt containing precipitate is separated from the resulting solution by any standard technique such as filtration.

The cobalt containing precipitate can be washed with hot water to remove any excess solution.

The cobalt containing precipitate is then reduced to form cobalt metal powder having a FSSS of no greater than about 2.1. The FSSS has been found generally to be inversely proportional to the amount of acid used in the digestion down to some minimum value which appears to be about 1.2. This is the desired FSSS for various applications requiring fine cobalt metal powder.

Reduction is carried out by known methods such as in a hydrogen atmosphere for a time of from about 1 hour to about 6 hours at a temperature of from about 350° C. to about 600° C.

To more fully illustrate this invention, the following nonlimiting examples are presented. All parts, portions, and percentages are on a weight basis unless otherwise stated.

EXAMPLE 1

About 136 parts of cobaltic hexammine chloride are added to a 2 liter autoclave containing about 1500 parts of deionized water containing varying amounts of 12N HCl. The resulting solution contains about 20 g Co/l. The autoclave is sealed and the resulting mixture is stirred and heated to about 160° C. and allowed to remain at that temperature for about 11 minutes. After being allowed to cool to room temperature, the resulting slurry is filtered. The solids obtained are slurried three times with hot deionized water and dried at about 110° C. The washed solids are then reduced under hydrogen at about 500° C. The following data are obtained from these tests.

| Test No. | Mole Ratio HCl/Co | FSSS of Co Metal Powder |
|---|---|---|
| 1 | 0 | 2.2 |
| 2 | 0.047 | 2.1 |
| 3 | 0.094 | 1.5 |
| 4 | 0.189 | 1.2 |
| 5 | 0.35 | 1.2 |
| 6 | 0.71 | 1.2 |

EXAMPLE 2

The procedure in Example 1 is repeated except that the solution is heated to about 140° C. and allowed to digest for about 2 hours. The following are data from these tests.

| Test No. | Mole Ratio HCl/Co | FSSS of Co Powder |
|---|---|---|
| 7 | 0 | 3.3 |
| 8 | 0.094 | 1.2 |
| 9 | 0.189 | 1.5 |

EXAMPLE 3

The procedure in Examples 1 and 2 is repeated except that the solution is heated to about 120° C. and allowed to remain at that temperature for about 2 hours. The following data are obtained.

| Test No. | Mole Ratio HCl/Co | FSSS of Co Powder |
|---|---|---|
| 10 | 0 | 2.2 |
| 11 | 0.094 | 1.7 |
| 12 | 0.189 | 1.2 |

From the above results it can be seen that addition of hydrochloric acid results in a lower FSSS in the cobalt metal powder than when no hydrochloric acid is added, and furthermore that the greater the amount of hydrochloric acid present at a given digestion temperature, the lower is the FSSS of the cobalt metal powder.

While there has been shown and described what are at present considered the preferred embodiments of the invention, it will be obvious to those skilled in the art that various changes and modifications may be made therein without departing from the scope of the invention as defined by the appended claims.

What is claimed is:

1. A method for producing fine cobalt metal powder comprising digesting a cobaltic ammine halide in an aqueous solution with a mineral acid at a temperature of at least about 110° C. for a sufficient time to decompose said cobaltic ammine halide to form an amorphous hydrated cobalt oxide containing precipitate, the digestion being carried out at a suitable pressure in a sufficiently closed vessel to permit said temperature being attained in said solution, said aqueous solution of said cobaltic ammine halide containing from about 5 grams of cobalt per liter up to the limits of solubility of said cobaltic ammine halide, and said mineral acid being present in an amount sufficient to result in the subsequent cobalt metal powder having a Fisher Subsieve Size of no greater than about 2.1, separating the cobalt containing precipitate from the resulting solution, reducing said cobalt containing precipitate to form said fine cobalt powder.

2. A method of claim 1 wherein said soluble cobaltic ammine halide is selected from the group consisting cobaltic pentammine halide, cobaltic hexammine halide and mixtures thereof.

3. A method of claim 2 wherein said cobaltic ammine halide comprises substantially all cobaltic hexammine chloride.

4. A method of claim 1 wherein said mineral acid is hydrochloric acid.

5. A method of claim 4 wherein said hydrochloric acid is present in at least about 0.04 moles per mole of cobalt.

6. A method of claim 5 wherein said hydrochloric acid is present at from about 0.09 to about 0.2 moles per mole of cobalt.

* * * * *